US007686061B2

(12) United States Patent
Mullet et al.

(10) Patent No.: US 7,686,061 B2
(45) Date of Patent: Mar. 30, 2010

(54) WINDING ASSEMBLY FOR DOOR COUNTERBALANCE SYSTEM

(75) Inventors: Willis Jay Mullet, Gulf Breeze, FL (US); Kelly R. Green, Pace, FL (US)

(73) Assignee: Overhead Door Corporation, Lewisville, TX (US)

( * ) Notice: Subject to any disclaimer, the term of this patent is extended or adjusted under 35 U.S.C. 154(b) by 1251 days.

(21) Appl. No.: 10/132,540

(22) Filed: Apr. 24, 2002

(65) Prior Publication Data

US 2003/0201077 A1 Oct. 30, 2003

(51) Int. Cl.
*E05F 15/00* (2006.01)

(52) U.S. Cl. ..... 160/191; 160/192; 160/315; 49/200

(58) Field of Classification Search ..... 160/191, 160/192, 201, 315, 302; 16/197, 198; 49/200; 74/577 M; 188/82.7
See application file for complete search history.

(56) References Cited

U.S. PATENT DOCUMENTS

| | | | | |
|---|---|---|---|---|
| 138,493 | A * | 5/1873 | Fritts | 160/306 |
| 575,572 | A | 1/1897 | Parsons | 160/315 |
| 842,936 | A | 2/1907 | Case | 160/315 |
| 1,994,142 | A | 3/1935 | Madsen | 20/19 |

(Continued)

FOREIGN PATENT DOCUMENTS

| | | |
|---|---|---|
| DE | 93 10 792 U | 5/1994 |
| EP | 1 170 450 A2 | 6/2001 |
| WO | WO 98/20224 | 5/1998 |
| WO | WO 03/040500 A1 | 5/2003 |

OTHER PUBLICATIONS

Wayne-Dalton Corp.'s Drawing No. 075-0274 for Inside Adjuster.
Wayne-Dalton Corp.'s Drawing No. 075-0274-2 for Inside Adjuster.

*Primary Examiner*—Blair M. Johnson
(74) *Attorney, Agent, or Firm*—Renner Kenner Greive Bobak Taylor & Weber

(57) ABSTRACT

A winding assembly used in conjunction with a door having a counterbalance system operable to offset the weight of the door, the counterbalance system including an axle rotatably supported on a pair of support brackets located at each side of the door and a counterbalance spring adapted to apply a counterbalancing force to the door. The winding assembly including a rotatable driver coupled to the counterbalance spring, the driver having a tool receiving portion, a gear wheel supported on the driver and rotatable therewith, the gear wheel defining a plurality of teeth, wherein at least one of the teeth carries a detent, whereby the detent provides a positive step to the pawl and gives an audible indication of the position of the gear wheel, and a lock assembly used in conjunction with a door system located within an opening defined by a frame, the door system including a door movable between an open position and a closed position, the door being supported on a pair of support brackets at either end of the door, a counterbalance system adapted to apply a counterbalancing force to the door, and a winding assembly adapted to adjust and maintain the counterbalancing force, the locking assembly having a lock bracket coupled to the winding assembly and fastenable to the frame to fix the winding assembly in a selected position, and a catch extending from the lock bracket and adapted to anchor the lock bracket to the frame upon unfastening of the lock bracket.

26 Claims, 9 Drawing Sheets

U.S. PATENT DOCUMENTS

| | | | | | |
|---|---|---|---|---|---|
| 2,097,242 | A | | 10/1937 | Robinson | 20/20 |
| 2,245,902 | A | * | 6/1941 | Cohn | 74/577 M |
| 3,672,492 | A | | 6/1972 | Sherr | 160/133 X |
| 3,734,161 | A | | 5/1973 | Pierce | 160/133 |
| 3,979,977 | A | | 9/1976 | Dorma | 81/57.13 |
| 4,253,350 | A | | 3/1981 | De Tarr | 81/3 R |
| 4,356,668 | A | | 11/1982 | Wagner | 49/506 |
| 4,472,910 | A | | 9/1984 | Iha | 49/139 |
| 4,570,873 | A | * | 2/1986 | Kurtti | 242/107.4 |
| 4,583,706 | A | | 4/1986 | Whitehouse et al. | 160/133 X |
| 4,597,224 | A | | 7/1986 | Tucker | 49/199 |
| 4,693,453 | A | * | 9/1987 | Ivan | 254/323 |
| 4,817,927 | A | | 4/1989 | Martin | 267/155 |
| 4,930,182 | A | | 6/1990 | Eichenberger | 16/198 |
| 4,940,193 | A | * | 7/1990 | Grabowski | 242/107.3 |
| 4,981,165 | A | | 1/1991 | Miller et al. | 160/191 |
| 5,222,327 | A | | 6/1993 | Fellows et al. | 49/139 |
| 5,239,777 | A | | 8/1993 | Husselton | 49/200 |
| 5,253,693 | A | | 10/1993 | Marlatt et al. | 160/315 X |
| 5,419,010 | A | | 5/1995 | Mullet | 16/198 |
| 5,605,079 | A | | 2/1997 | Way | 81/61 |
| 5,615,723 | A | | 4/1997 | Carper | 160/191 |
| 5,632,063 | A | * | 5/1997 | Carper et al. | 16/198 |
| 5,636,678 | A | * | 6/1997 | Carper et al. | 160/191 |
| 5,778,490 | A | | 7/1998 | Curtis | 16/198 |
| 5,865,235 | A | * | 2/1999 | Krupke et al. | 160/191 |
| 5,911,797 | A | | 6/1999 | Trevorrow et al. | 81/176.1 |
| 5,964,268 | A | * | 10/1999 | Carper et al. | 160/191 |
| 6,125,582 | A | * | 10/2000 | Mondragon et al. | 49/200 |
| 6,134,835 | A | * | 10/2000 | Krupke et al. | 49/200 |
| 6,155,327 | A | | 12/2000 | Wells et al. | 160/310 |
| 6,283,193 | B1 | | 9/2001 | Finch et al. | 160/191 |
| 6,401,792 | B1 | * | 6/2002 | Mullet et al. | 160/188 |
| 6,527,037 | B2 | * | 3/2003 | Daus et al. | 160/315 |
| 6,644,378 | B2 | * | 11/2003 | Mitchell | 160/191 |
| 2002/0162634 | A1 | * | 11/2002 | Dorma | 160/201 |

* cited by examiner

WINDING ASSEMBLY FOR DOOR COUNTERBALANCE SYSTEM

BACKGROUND ART

In general, the present invention relates to a door winding device. Such devices are commonly used to maintain and adjust the tension of a spring used to counterbalance the weight of a door. A door may be an upwardly acting door, such as, for example, a rolling door having a curtain made of flexible material which is coiled about a drum wheel or a sectional door made up of a plurality of panels. To provide a counterbalancing force for the weight of the door, a spring is attached at one end to one or more of the drum wheels and at its other end to a tensioning assembly. In the past, the door's support bracket would act as the tensioning assembly.

Sectional doors retain many of the same components as the described rolling door, but differ slightly in operation. In particular, as opposed to rolling the door about drum wheels mounted on the axle, most sectional doors employ a track system that guides the door panels from a generally closed vertical position to a generally open horizontal position. As in the case of a rolling door, the sectional door employs a counterbalance system having a spring to counteract the weight of the door. In both sectional and rolling doors, once the door and axle were mounted on support brackets, the free end of the spring would be attached to one support bracket and the spring would be rotated to charge the spring. Optimally, the counterbalance spring would have sufficient tension, such that the door would fully close and only a small amount of force would be necessary to raise the door from the closed position. If the door is not in the optimal position, the installer would adjust the spring tension by repositioning the end of the spring and the support bracket. After which, the installer would reassemble these components and repeat the pre-tensioning procedure to charge the spring.

To avoid repositioning of the spring on the bracket, alternative tensioning assemblies have been developed. In one such assembly, an axle tube is provided with a spring attaching plate and a tensioning plate. The tube is fit over the axle such that the plates may move independently of the axle. The plates are located on either side of the tensioning bracket and an end of the counterbalance spring passes through the spring attaching plate to eventually attach to the bracket. With the spring so attached, the axle tube may be rotated to increase or decrease tension on the spring. The plates are provided with multiple holes located radially equidistant from the center of the axle. To maintain the tension on the spring, a pin is passed through the holes in each plate to fix the plates relative to each other and the bracket preventing rotation of the axle tube. Adjustment may be made by removing the pin and rotating the axle tube hole to the next appropriate hole and reinserting the pin.

As will be appreciated, this tensioning assembly may be difficult to use. The user must rotate the axle tube with a suitable tool in one hand to align the holes in the spring attaching plate, tensioning bracket, and tension plate, and, with the other hand, attempt to insert a pin through these holes. As a result, once the installer has the holes aligned, he must maintain the exact tension on the axle tube to preclude relative rotation that would take the holes out of alignment.

A further disadvantage of this system is that the slidable pin may become disengaged by efforts to tamper with the door or other accidental contact with the pin. Essentially, the pin is not axially held, but for the frictional forces created by the plates and bracket. Therefore, a person could remove the pin without tools or extensive effort causing unintentional release of the spring's tension. It will be appreciated that such a release could make it difficult or impossible to operate the door and, in more dire instances, cause serious injury.

In another system, a collar is slipped over a rod around which the counterbalance spring is wound. The collar engages the spring and is fitted with a pair of ratcheting mechanisms and a assembly to hold the same in place while the ratchets are used to apply the correct tension to the spring. A similar system provides a tool for applying rotational force to a coiled torsion spring of a door counterbalancing mechanism including a split housing fixedly mounted onto a winding cone of the torsion spring. The housing has a sprocket provided with annular grooves on either side. A right-hand operated ratchet tool and left-hand ratchet tool fit within the corresponding grooves and are used sequentially in unison to create stored energy within the torsion spring. Still another tool includes an adapter used with existing door structures to tension the springs during periodic maintenance. The adapter includes a body that may be mounted upon a rotatable shaft supporting the coil springs and is nonrotatably attached to the end of the coil spring and rotatable shaft. The system further includes two improved wrenches for tensioning the springs, which have jaws that engage splines on the adapter body. To tension the door, the splines are engaged and rotated with the wrenches in an alternate manner, such that the coil spring is wound to increase or decrease the tension stored therein. It will be appreciated that the above-described systems are impractical to ship with each door and may be difficult for an inexperienced installer to use, if not dangerous.

Still other systems of tensioning a door in the industry employ a worm gear/worm reducer that allows the use of an electric power tool, such as a drill motor, to tension the door's counterbalance springs. These systems are generally made integral with the counterbalance system and significantly increase the overall cost of the door. Since a power tool is required to tension the door, it will be appreciated that, when the door is installed before the home or other structure is complete and before electric power is available, it may be impracticable or impossible to fully install the door. In addition, theses systems typically require a wind counter to indicate the tension on the door spring, which may not be easily viewed in the sometimes dark conditions in a garage without electrical power.

DISCLOSURE OF THE INVENTION

It is, therefore, an aspect of the present invention to provide a door winding assembly that automatically prevents rotation of the axle tube as the installer rotates the tube to a desired position. A further aspect of the present invention is to provide a tensioning assembly that includes a gear and spring-loaded pawl to hold the axle tube at the desired position. It is another aspect of the present invention to provide a locking assembly that locks either of the gear or pawl to a support bracket, where the locking assembly cannot be accidentally removed without extensive effort or the aid of tools. It is another aspect of the present invention to provide a winding assembly for a counterbalance system that uses an interlocking gear mounted on a driver and a pawl mounted on a lock bracket to prevent accidental or inadvertent unwinding of the tension on the counterbalance system. It is a further aspect of the present invention to provide a lock bracket that is fastened to the frame to which a door is mounted to prevent release of the tension on the counterbalance system. It is still another aspect of the present invention to provide secondary means for attaching the lock bracket to the frame, such that in the event that the lock bracket is accidentally unfastened, the secondary means couples the lock bracket to the frame to prevent unwinding of the tension on the counterbalance system. It is yet another aspect of the present invention to provide an anchor adapted to couple the lock bracket to the frame upon unfastening of the lock bracket.

It is another aspect of the present invention to provide a tensioning device for a counterbalance system that can mount within the confines of the track system to allow the door to be installed into openings about the same size as the perimeter of the track system. It is a further aspect of the present invention to provide a plate-like splice member that connects the horizontal and vertical sections of the tracks while supporting them on the frame. It is still another aspect of the present invention to provide a winding assembly that adjusts the tension on the counterbalance system having a tool receiving socket extending axially inward at the end of the driver where the end of the driver is exposed by an opening within the splice member. It is yet another aspect of the present invention to provide a driver that substantially fits within the confines of a cable drum in the counterbalance system.

In general, the present invention contemplates a door system located within an opening defined by a frame, the door system having a door movable between an open position and a closed position, a pair of tracks including a substantially vertical track section, a substantially horizontal track section, and an arcuate transition track section joining the vertical and horizontal track sections and adapted to guide the door between the open and closed positions, splice brackets attached to the frame and adapted to support the tracks, a counterbalance system including an axle rotatably supported by the splice brackets and a counterbalance spring supported by the axle, the counterbalance spring being adapted to apply a counterbalancing force to offset the weight of the door, a driver extending axially outward from the axle, coupled to the counterbalance spring and rotatably supported within an opening formed in one of the splice brackets, wherein an end of the driver is accessible through the opening and includes a tool receiving socket extending axially inward therefrom, and a winding assembly including a gear and pawl adapted to maintain a selected counterbalance force within the counterbalance system.

BEST MODE FOR CARRYING OUT THE INVENTION

Figure 1:
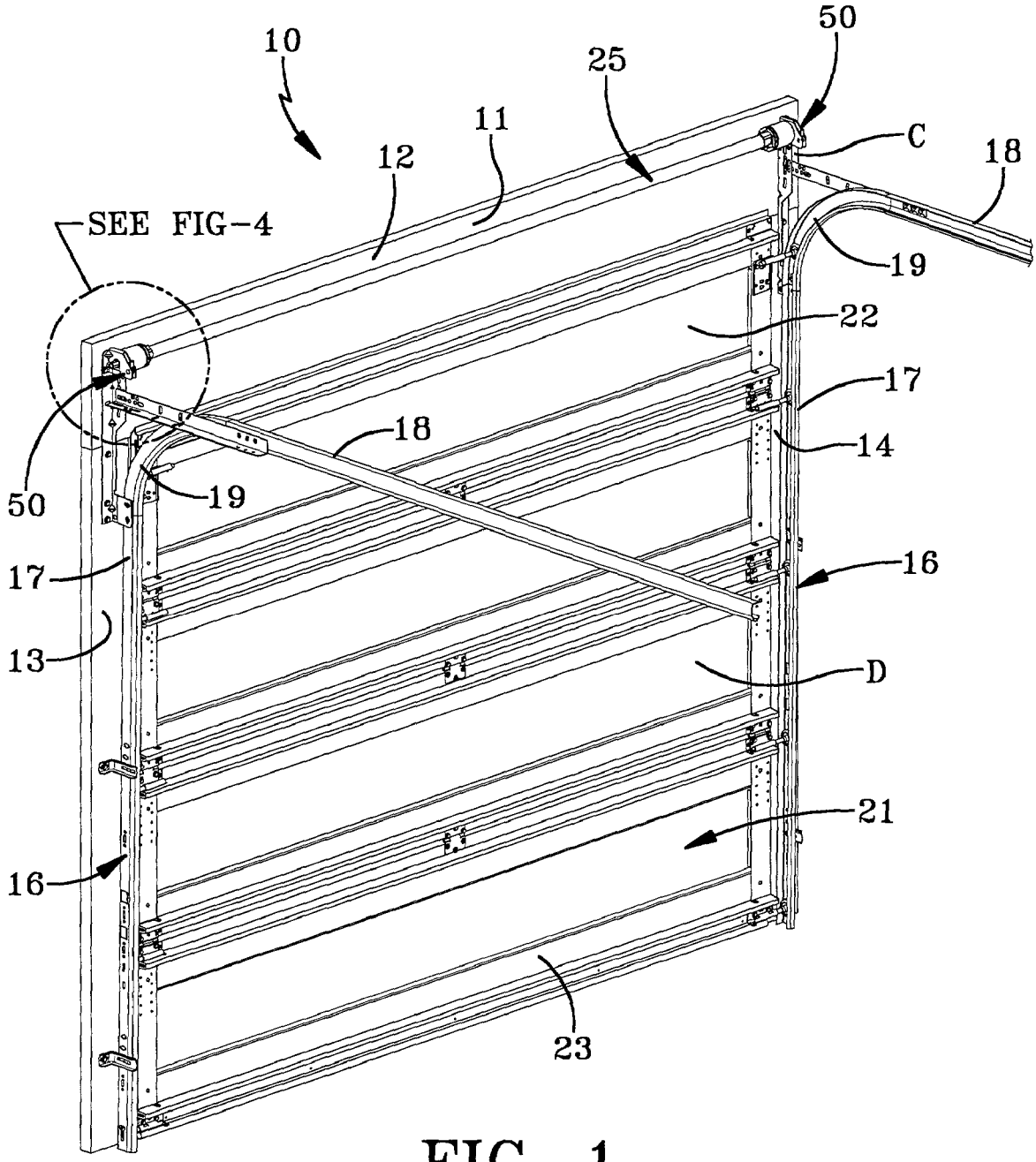
FIG. 1 is a rear perspective view of an upwardly acting door located within an opening defined in a building and having a counterbalance system operative to provide a balancing force for the weight of the door and a winding assembly according to the concepts of the present invention attached to one end of the counterbalance system to adjust and retain the force applied to the door by the counterbalance system.
Figure 2:
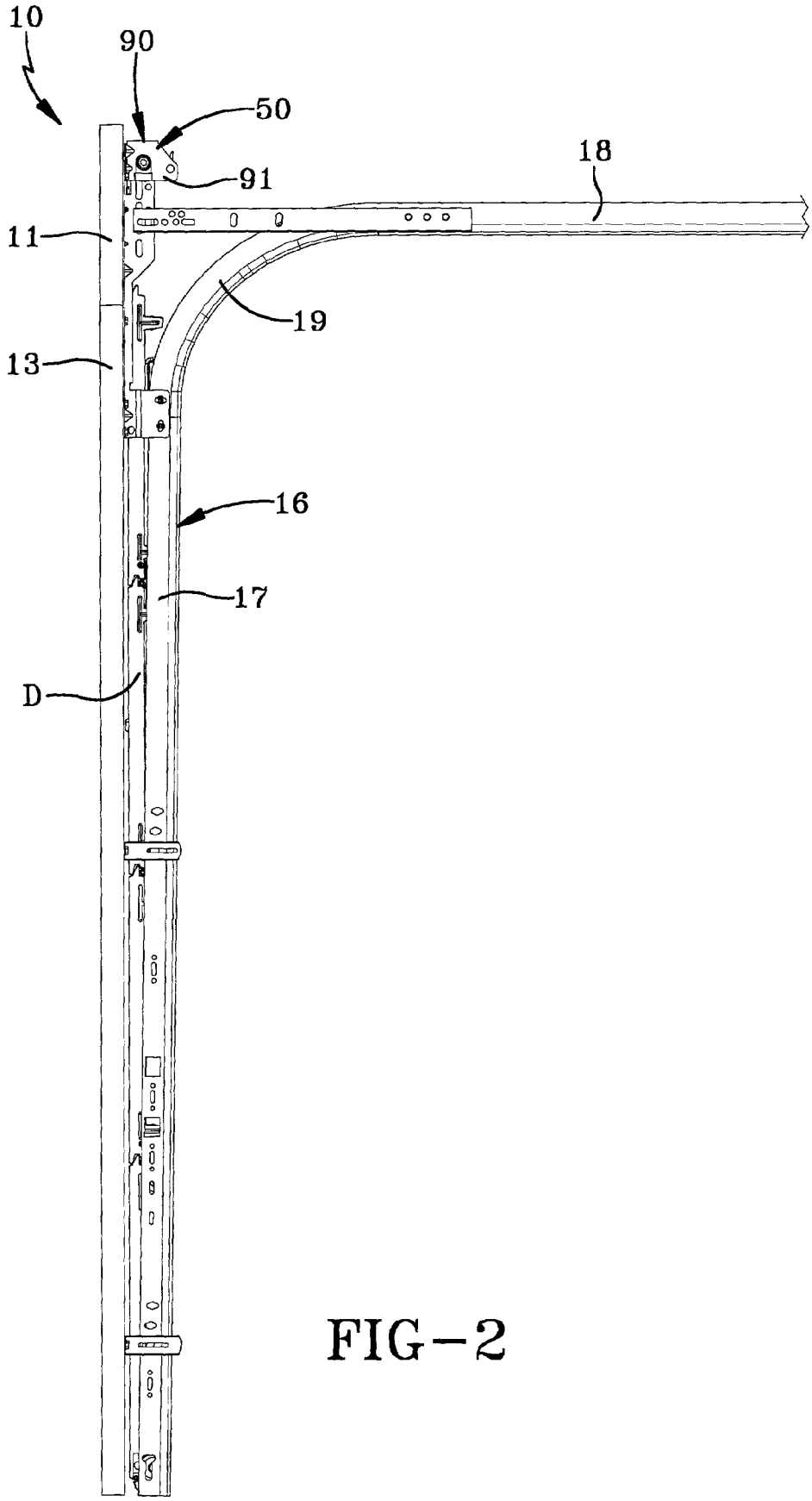
FIG. 2 is a left side elevational view of an upwardly acting door depicting a support bracket and winding assembly to the left of the door, as seen in FIG. 1, including a locking assembly shown in a secured position covering the winding assembly.
Figure 3:
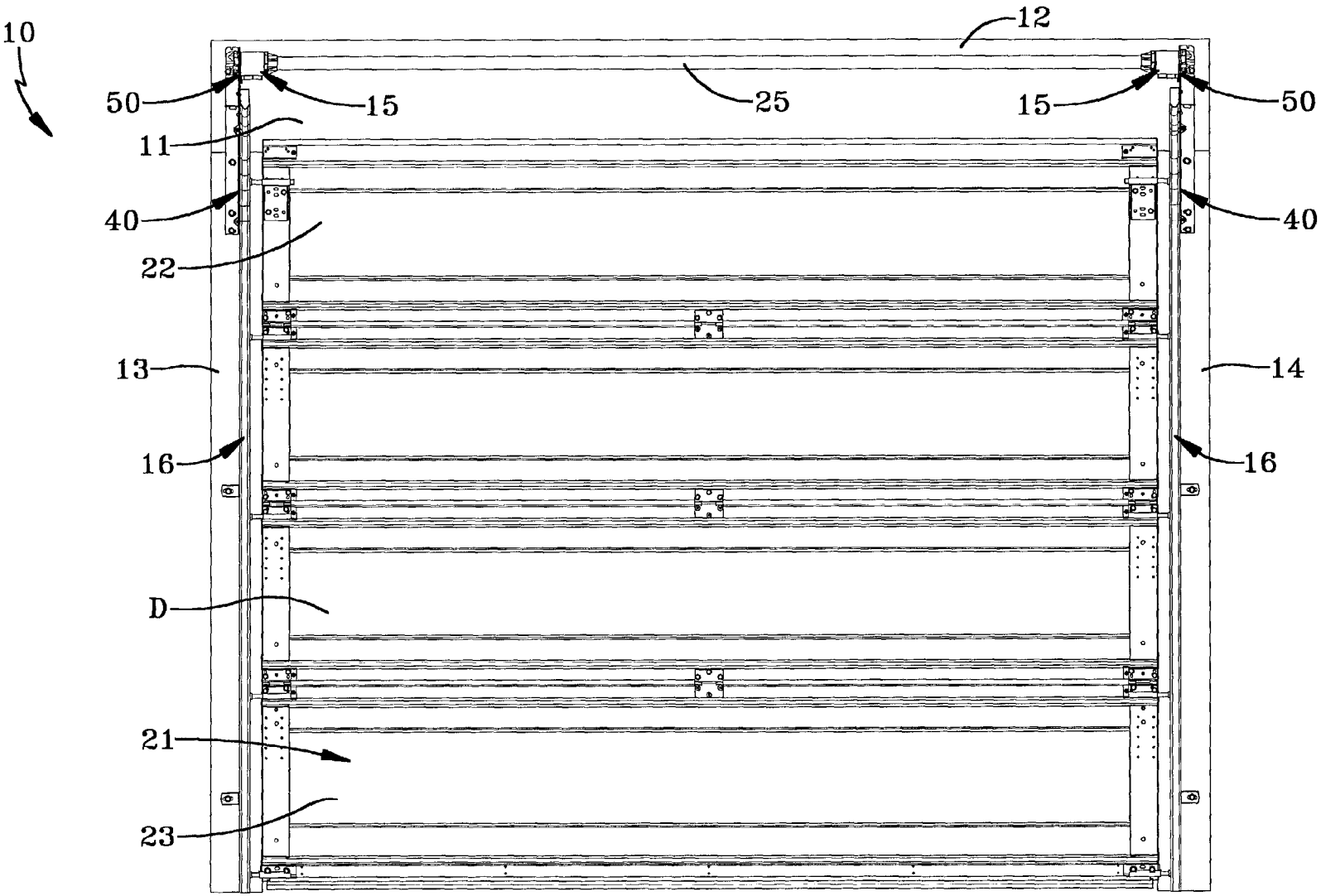
FIG. 3 is a rear elevational view of an upwardly acting door, as seen in FIG. 1, depicting winding assemblies located at either end of the counterbalance system above the door.

A winding assembly according to the concepts of the present invention is shown in the accompanying figures, and generally referred to by the numeral 50. The winding assembly 50 is used in connection with a door assembly, generally referred to by the numeral 10, that includes a framework 11 made up of a header 12 and a pair of vertical jambs 13, 14, having guide tracks, generally indicated by the numeral 16, which receive door D, mounted thereon. This framework 11 defines an opening in which the door D is selectively moved from a closed vertical position depicted in FIG. 1 to an open position (not shown) where the door D is retracted from the opening. In the example shown, a pair of cable drums, generally indicated by the numeral 15, carried on an axle 20, which, as shown, may take the form of a tube that carries a cable C used to couple the bottom of the door D in conventional fashion to a counterbalance system, generally indicated by the numeral 25, described more completely below.

In general, door D may be an upwardly acting door, such as the sectional door shown by way of example in the figures. It will be understood that the winding assembly 50 of the present invention may be used with other known doors. The door D may be constructed of a plurality of panels 21 including a top panel 22 and a bottom panel 23.

The door D is supported on guide tracks 16, such that upon opening the door D, the door panels 21 are sequentially transferred from a substantially closed vertical condition to a substantially open horizontal condition to store the door D in a compact fashion above the opening. To that end, guide tracks 16 each include a vertical track section 17 and a horizontal track section 18 joined by an arcuate transition track section 19.

To facilitate raising and lowering of the door D, the counterbalance system 25 may be employed to offset the weight of the door D. The counterbalance system 25 may include a counterbalance spring 26 (FIG. 4) constructed of suitable resilient material, for example, steel, for applying a torsional force to the door D. Counterbalance spring 26 may be a coil spring located generally coaxially with and housed within axle 20. Alternatively, counterbalance spring 26 may be located externally of axle 20 or coiled around axle 20. Counterbalance spring 26 is attached at its first end 32 to a driver, generally indicated by the numeral 35, and at its second end 31 to axle 20, directly or by clips or fasteners. In this way, relative rotation of the ends 31, 32 of counterbalance spring 26 may be used to achieve the desired force imposed by counterbalance spring 26, The counterbalance system 25 may be in accordance with Applicant's Assignee's U.S. Pat. No. 5,419,010 and the disclosure therein is incorporated herein by reference.

Figure 4:
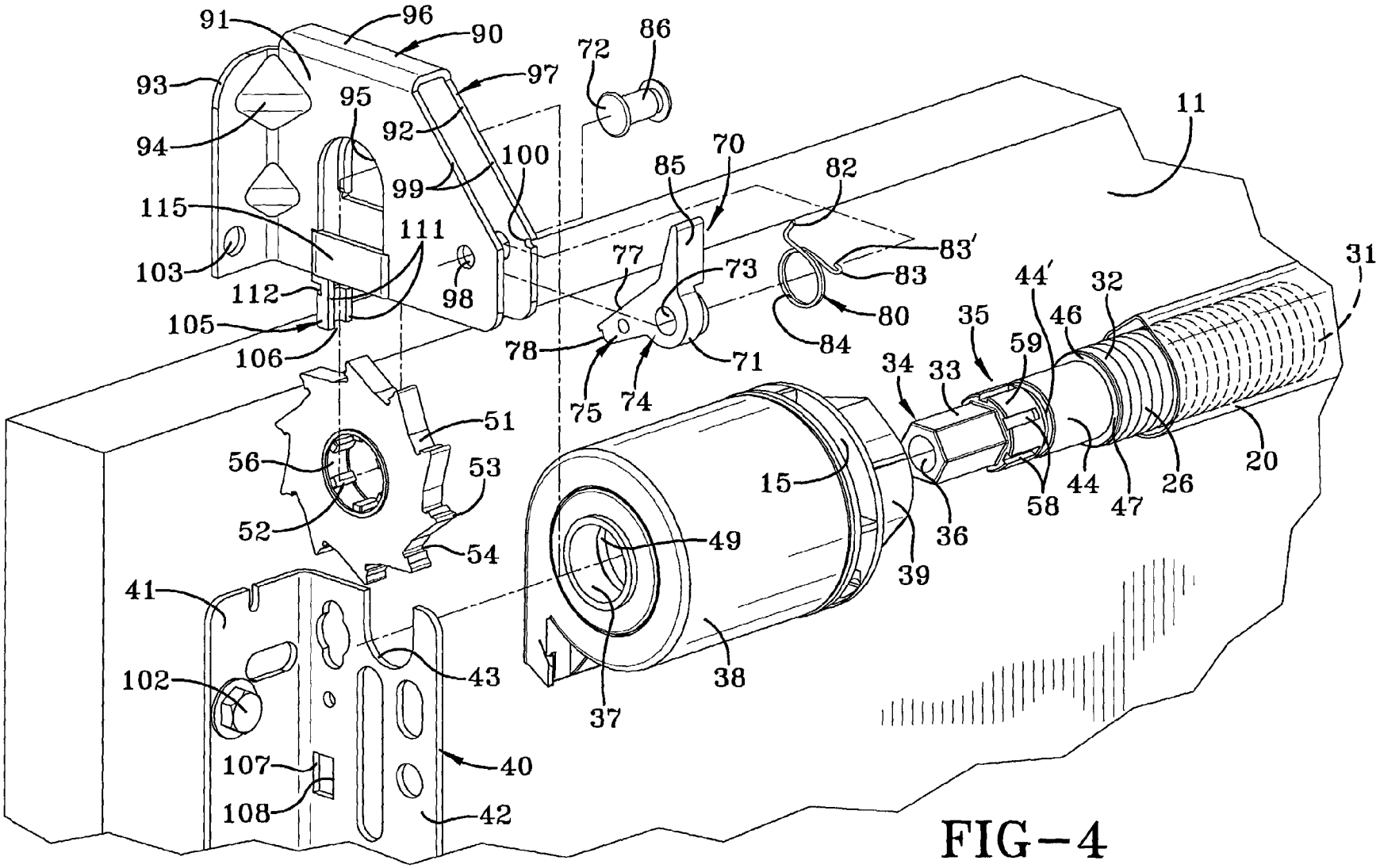
FIG. 4 is an enlarged exploded perspective view depicting a support bracket and winding assembly to the left of the door as seen in FIG. 1 depicting details of the winding assembly including a spring holder and a gear supported on an axle tube on either side of a support bracket, and a pawl pivotally attached to the support bracket, and biased into locking engagement with the gear by a biasing member to prevent rotation of the spring holder.

Referring particularly to FIG. 4, the axle 20 and driver 35 are supported by a support bracket, generally indicated by the numeral 40. Support bracket 40 includes a mounting flange 41 suitably attached to the framework 11, or other supporting structure as by cap screws and has an axle supporting portion 42 projecting rearwardly of the frame 11. Axle supporting portion 42 has an opening 43 that receives the driver 35. The opening 43 is sized, such that driver 35 is free to rotate therein. A tool end 34 of driver 35 may protrude axially outward of support bracket 40 to receive a tool used to rotate driver 35, as shown in FIG. 4 and as described below.

Figure 5:
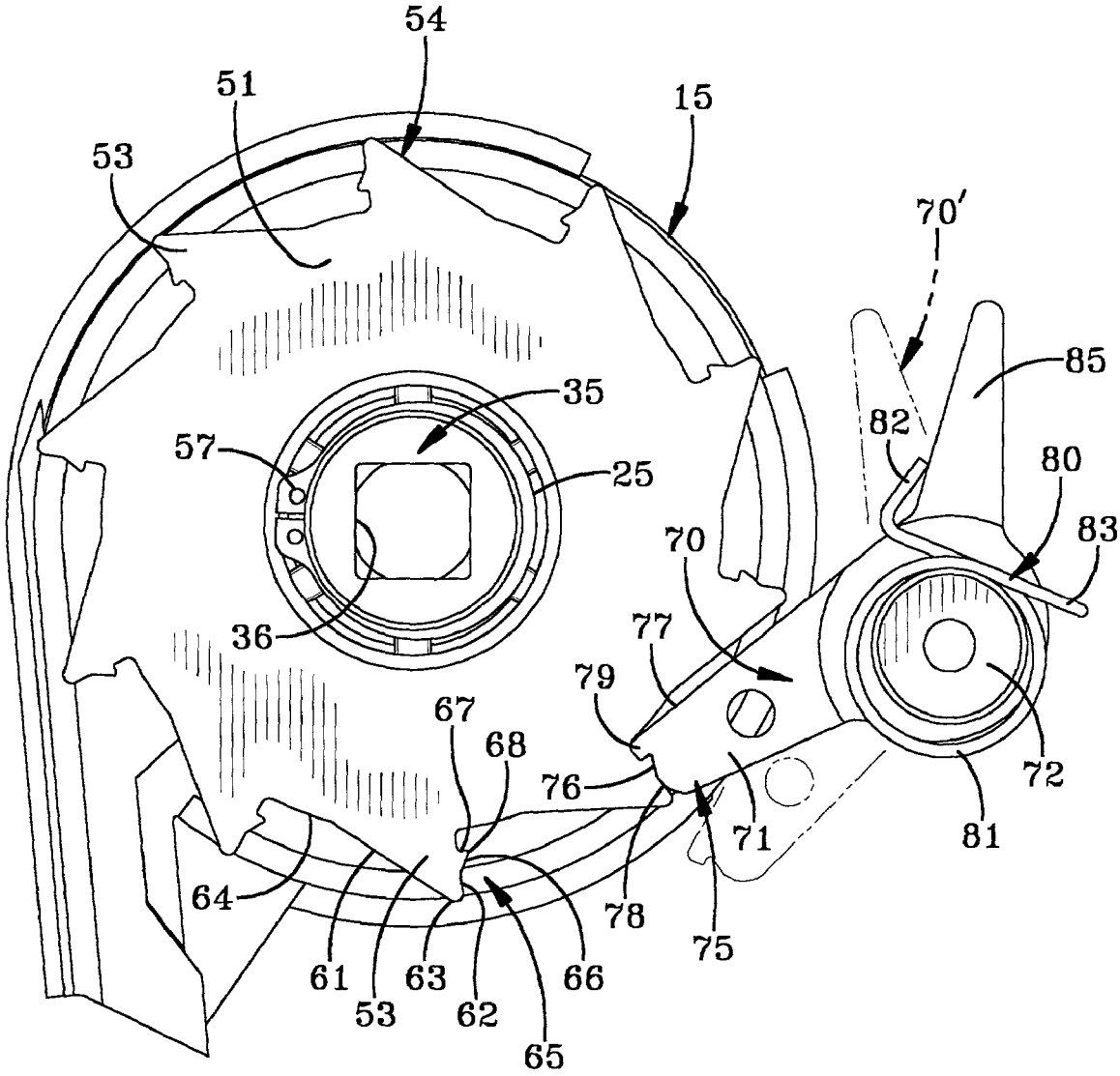
FIG. 5 is an enlarged left side elevational view of the winding assembly seen in FIG. 2 depicting the winding assembly supported on a support bracket where the winding assembly includes a gear supported on a driver and a pawl biased into locking engagement with the gear, the engaged position of the pawl, which prevents the gear from rotating, being shown in solid lines with a disengaged position of the pawl, allowing free rotation of the gear, being shown in chain lines.

Since the driver 35 may be rotated independently of axle 20, driver 35 may be rotated to adjust the counterbalancing force generated by counterbalance spring 26. To facilitate the use of ordinary tools to apply tension to the counterbalance spring 26, a tool end 34 of driver 35 may be provided with a faceted outer surface 33 and/or a tool receiving socket 36, generally indicated by the numeral 36. For example, surface 33 may have a polygonal section, for example, a hexagon, providing a convenient bearing surface for a conventional wrench. Alternatively, or in addition to the faceted outer surface 33, tool end 34 may define a tool and receiving socket 36. The tool receiving socket 36 may be formed on any part of the tool end 34 to provide for the insertion of a tool that provides sufficient leverage to rotate the driver 35 including, for example, an "allen wrench" or a socket extending axially inward from the end of the driver, as best shown in FIGS. 4 and 5. The shape of socket 36 would conform to that of the appropriate tool, for example the head of a screw driver, "Torx® wrench", or "allen wrench", and may be adapted to receive the end of a socket wrench driver as shown in FIG. 5. To provide access to either the end socket 36 or surface 33, driver 35 may extend through the bore 37 of cable drum 15. In the embodiment shown in FIG. 4, the tool end 34 of driver 35 extends beyond the radial plane of cable drum 15, such that it is exposed axially of the cable drum allowing a tool to be implemented in connection with the faceted surface 33 to wind the counterbalance spring 26.

In the embodiment shown, cable drum 15 is rotatable within a housing 38 and keyed or otherwise coupled to the drive tube 20, such that the cable drum rotates therewith. For example, as shown in FIG. 4, cable drum 15 may be keyed by having a noncircular receptacle 39 that corresponds to a noncircular shaped axle 20. This embodiment is shown for example only and it will be appreciated that there are several equally suitable methods of rotationally coupling the cable drum 15 to axle 20. As mentioned, driver 35 may protrude axially outwardly of the cable drum 15 through cable drum bore 37 and may be rotationally supported on bracket 40, as within opening 43 formed in the bracket 40. To facilitate rotation of the driver 35 and, by association, axle 20, driver 35 may be provided adjacent bushing portion 44 which has a groove 44' that extends through bore 37 and engages opening 43. To locate the cable drum 15, on the driver 35, a radially extending flange 46 may be located at an interior end 47 of bushing portion 45 to act as a stop against the edge 49 of cable drum bore 37. Flange 46 may also be used to locate the counterbalance spring 26, as shown.

Still referring to FIG. 4, a winding assembly 50 is provided to adjust and maintain the tension of counterbalance spring 26. It will be appreciated that the winding assembly 50 may be included within a door system 10, or be provided as a separate unit to be used with or retrofit to existing systems. It will be appreciated that some modification of such systems may be needed, in the course of using winding assembly 50 with such systems and such modification is within the scope of the present invention. The incorporation of winding assembly 50 in the described door system 10 is provided only as an example. The winding assembly 50 includes a gear wheel 51 supported on driver 35 made rotatable therewith. Gear wheel 51 may be made rotatable with driver 35 in any suitable manner including, for example, keying. In the embodiment shown, gear wheel 51 is keyed to driver 35 by a plurality of splines 52 extending radially inward into the gear wheel bore 56 that mate with corresponding recesses 58 formed in a portion of the driver 35. Driver 35 may, for example, be provided with a spline receiving collar 59 located between the bushing portion 44 and tool end 34. As best shown in FIG. 5, a spring retainer 57 may be used to limit axial movement of the gear wheel 51.

Referring particularly to FIG. 5, gear wheel 51 includes a plurality of radially projecting teeth 53 having notches 54 therebetween. Teeth 53 are generally triangular in shape and have a lead surface 61 and trailing surface 62 on either side of the tip 63 of teeth 53. Relative to a radially extending line, the leading surface 61 of tooth 53 has a positive slope. The trailing side 62 of tooth 53 may be parallel to the radial line or be undercut, creating a positive slope relative to the radial line, as shown. In the example shown, the degree of slope on the leading side 61 of tooth 53 is greater than the slope of the trailing side 62. Further, as shown in FIG. 5, the teeth 53 may be circumferentially spaced from each other by a land 64, which, as shown, may be arcuate and may lie along the same circle.

To provide an audible indication of engagement of the tooth 53 and to further provide a positive stop against movement of the pawl assembly, generally indicated by the numeral 70, described more completely below, a detent, generally indicated by the numeral 65, may extend from the trailing side 62 of teeth 53. In its general sense, the detent 65 is simply a protrusion formed on the trailing side 62 of tooth 53 that causes a momentary displacement of the pawl 71, such that it snaps into place beyond the detent 65 with an audible "click". To facilitate ingress of the pawl 71, the leading surface 66, relative to the pawl 71, may be sloped. For example, as best shown in FIG. 5, the leading surface 66 of detent 65 may be oblique relative to the plane of trailing side 62 of tooth 53. The trailing surface 67 of detent 65 may be formed at any angle but preferably it is steep, such that when pawl 71 passes the tip 68 of detent 65 it abruptly snaps into place beyond the detent 65. As one example, the trailing surface 67 may be formed similar to surface 62 of tooth 53, in this case, parallel to a line perpendicular to the trailing surface 62 of the tooth 53 or undercut relative to the line forming a positive angle relative thereto.

Teeth 53 interrelate with the pawl assembly 70 to incrementally maintain the position of end 32 of counterbalance spring 26 by way of driver 35. While the gear wheel 51 is shown with ten (10) teeth 53, the number of teeth 53 may be increased or decreased depending on a desired tensioning increment. The tensioning increment, in terms of one revolution of gear wheel 51, is essentially inversely proportional to the number of teeth 53. In the embodiment shown, the ten (10) teeth result in a tensioning increment of 1/10 of a revolution.

Further referring particularly to FIG. 5, pawl assembly 70 interacts with the teeth 53 and notches 54 to selectively hold the gear wheel 51 against the torsional force of counterbalance spring 26. Pawl assembly 70 includes a pawl 71 pivotally mounted to the axle supporting portion 42 of bracket assembly 40, as by a projecting retainer 72. To that end, pawl 71 may be provided with a bore 73 through which the retainer 72 is received at a pivot portion, generally indicated at 74, of pawl 71 (FIG. 4). A tooth engaging portion at 75 extends outwardly from the pivot portion 74 toward the gear wheel 51. Tooth engaging portion 75 is a wedge-like member having a first surface 77 that is engaged by the leading surface 61 of the teeth 53 and a second surface 78 that engages the trailing side 62 of teeth 53 to hold the gear wheel 51 against rotation initiated by the counterbalance spring 26. First surface 77 is generally planar and may be oriented, as by the affixation of the pawl 71 to bracket 40, obliquely relative to the circumferential path of the teeth 53. To provide a positive radial lock of the pawl 71, upon engagement with trailing surface 62 of teeth 53, the second surface 78 of pawl 71 may include a recess 76 adapted to receive the detent 65 of teeth 53. A lip 79 may be formed radially interiorly of the detent recess 76 that positively engages the trailing surface 67 of detent 65 in the radial direction to prevent accidental disengagement of the pawl 71.

To automatically lock the tensioning assembly 50, the pawl 71 may be biased into an engaged position with gear 51, as shown in solid lines in FIG. 5. The pawl 71 may be biased by gravity or a biasing assembly, generally indicated by the numeral 80, which includes a biasing member, such as spring 81. In the embodiment shown in FIGS. 4 and 5, spring 81 exerts a force on pawl 71 to drive it toward an engaged position (solid lines) by means of opposed first and second legs 82, 83. As best shown in FIG. 5, the spring 81 may be axially located by retainer 72, which forms a pivot for pawl 71. Retainer 72 may be a pin, clip, fastener, or other member that pivotally supports the pawl 71. As best seen in FIG. 4, the shank 86 of retainer 72 is sized to fit through a center portion 84 of spring 81 and into bore 73 formed in pawl 71. In the example shown, second end 83 of spring 81 is held fixed relative to the first end 82 of spring 81, as by a clip 83' (FIG. 4) formed in the end and secured to an adjacent member such as retainer 72. First end 82 may be displaced relative to second end 83 to prestress the spring 81. Then, first end 82 of spring 81 may be placed into contact with a projection 85 extending from pawl 71 to impart a biasing force to the pawl 71. As will be appreciated from the above description, the biasing force of the spring 81 may be provided in a variety of configurations and the spring 81 itself may take on many forms including a leaf spring or a coil spring, as shown.

Since the pawl 71 is biased into an engaged position, it will be appreciated that to release the pawl 71, the installer may push projection 85 away from second end 83 of spring 81 to urge the pawl 71 toward a disengaged position 70', shown in broken lines in FIG. 5, where the pawl 71 has cleared the adjacent tooth 53. With the pawl 56 disengaged, the gear 51 is free to rotate. With the gear 51 released, the installer may adjust the tension on counterbalance spring 26 by rotating driver 35 in the appropriate direction. Upon reaching the desired tension, the pawl 71 may be released allowing biasing assembly 80 to return the pawl 71 to the, solid line, engaged position. When the gear wheel 51 is rotated, such that the leading side 61 of the teeth 53 is driven against the first surface 77 of pawl 71, the teeth 53 and pawl 71 act in a cam follower fashion with the slope of the leading surface 61 of teeth 53 driving the pawl 71 radially outward relative to the teeth 53 against the bias force of the spring 81. In this fashion, the pawl 71 rides along the lead surface 61 of teeth 53 until passing the tip 63 of tooth 53, at which point, the pawl 71 rotates inwardly relative to the tooth 53 along the trailing surface 62 of the tooth. As the pawl 71 drops into the notch 54 between teeth 53, it may produce an audible "click" as its surface 77 contacts the surface 64 of gear wheel 51. Alternatively, the passing of the pawl 71 over detent 65, as previously described, results in an audible "click" and a positive locking of the pawl 71 against rotation caused by the torsional force of counterbalance spring 26.

Once suitable counterbalancing force has been achieved in the counterbalance system, to prevent tampering which could cause unintentional release of the counterbalancing force, a locking assembly, generally indicated by the numeral 90, may be used to prevent the driver 35 from rotating. As in the case of winding assembly 50, locking assembly 90 may form a part of a door system or a winding assembly, or it may be provided as a stand alone device to be used with existing systems. Locking assembly 90 may include a lock bracket 91 that is not easily removed to guard against accidental release of gear wheel 51. As best shown in FIG. 4, lock bracket 91 may be constructed to generally conform to a portion of bracket 40 and include a support portion 92 extending rearwardly of the door from a support flange 93. The connection between the portions 92, 93 may be reinforced with gussets 94. To accommodate the driver 35, an opening 95 corresponding to opening 43 is formed within the portion 92 of lock bracket 91. As shown, support portion 92 may include a pair of parallel plates 99 extending rearwardly of the attachment portion 93 that are spaced by a cap portion 96 joining the vertical upper extremities thereof, to define a U-shaped section. The spaced plates 99 define a suitable clearance, generally indicated at 97, sufficient to receive the gear wheel 51 and rearwardly extending portion 42 of bracket 40 therein.

Figure 9:
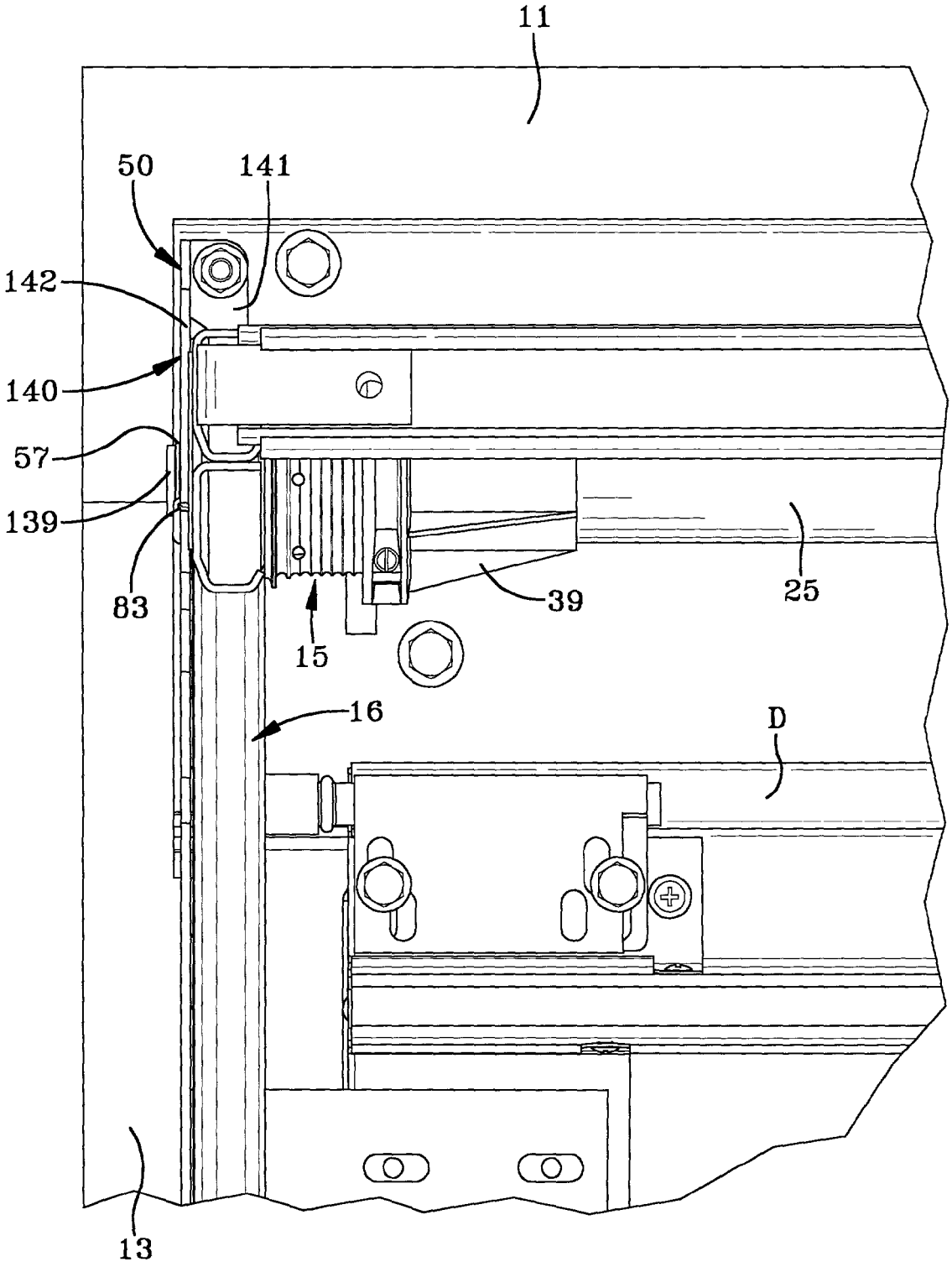
FIG. 9 is an enlarged fragmentary rear elevation view of the door shown in FIG. 8, depicting further details of the alternative winding assembly.
Figure 10:
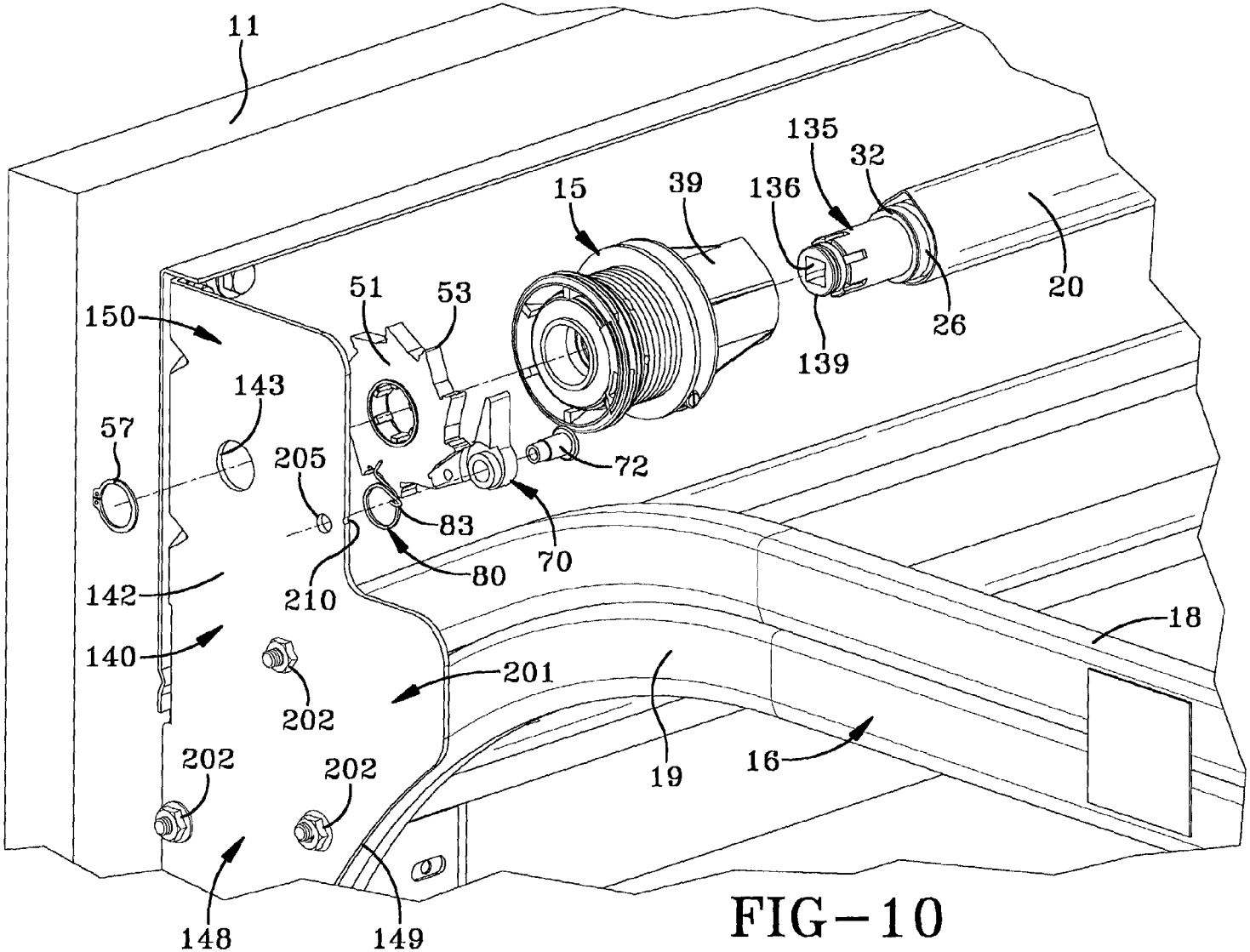
FIG. 10 is an enlarged fragmentary exploded view of the support bracket and winding assembly to the left of the door shown in FIG. 8, depicting further details of the support bracket and winding assembly including a splice of the horizontal and vertical track sections formed by the winding assembly support bracket and a shortened driver.

As indicated in FIG. 4, when using the lock bracket 91, the entire winding assembly 50 may be housed therein to provide additional safety to the user. To that end, a retainer receiving bore 98 may extend through the parallel plates 99 making up the support portion 92. As in the case of the gear wheel 51, the pawl 71 would reside between the plates 99. A receiver 100, which may be, for example, a notch, may be formed in one of the plates 99 to receive the second end 83 of the pawl spring 81. Since the pawl 71 is mounted on lock bracket 91 and operatively connected to the counterbalance spring 26 though the gear 51 and driver 35, the tension of the counterbalance spring 26 is, in effect, maintained by the affixation of the lock bracket 91 to the structure. To that end, a cap screw 102 securing the bracket 40 to the header 12 may be used to fasten the lock bracket 91 in a similar fashion. A receiver 103 may be formed in the attachment flange portion 93 of lock bracket 91 to accommodate the cap screw 102. As shown in FIG. 9, the screw is driven through the lock bracket 91 and bracket 40 into the structure, thereby securing the lock bracket 91 to the structure.

Figure 7:
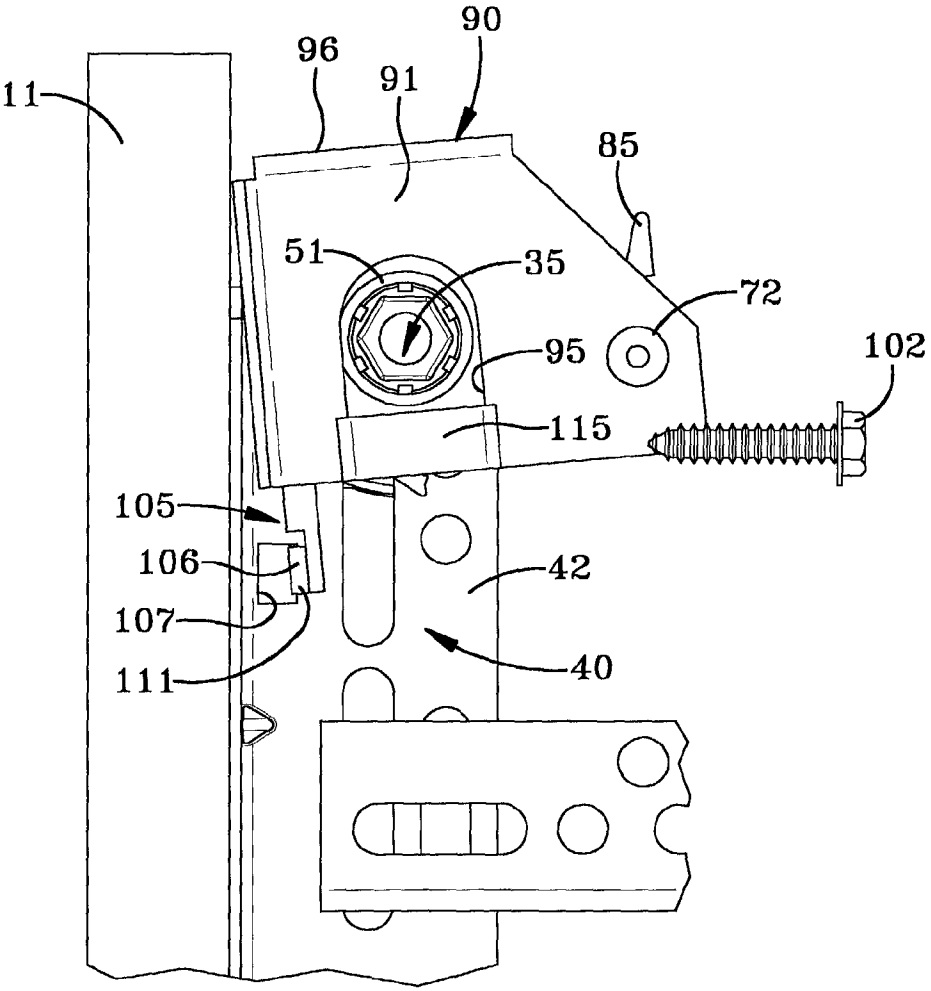
FIG. 7 is a left side elevational view similar to FIG. 6 depicting the fastener attaching the lock assembly to the frame removed and engagement of the anchor with the support bracket to hold the lock assembly in a position that prevents release of the tension within the counterbalance spring.
Figure 6:
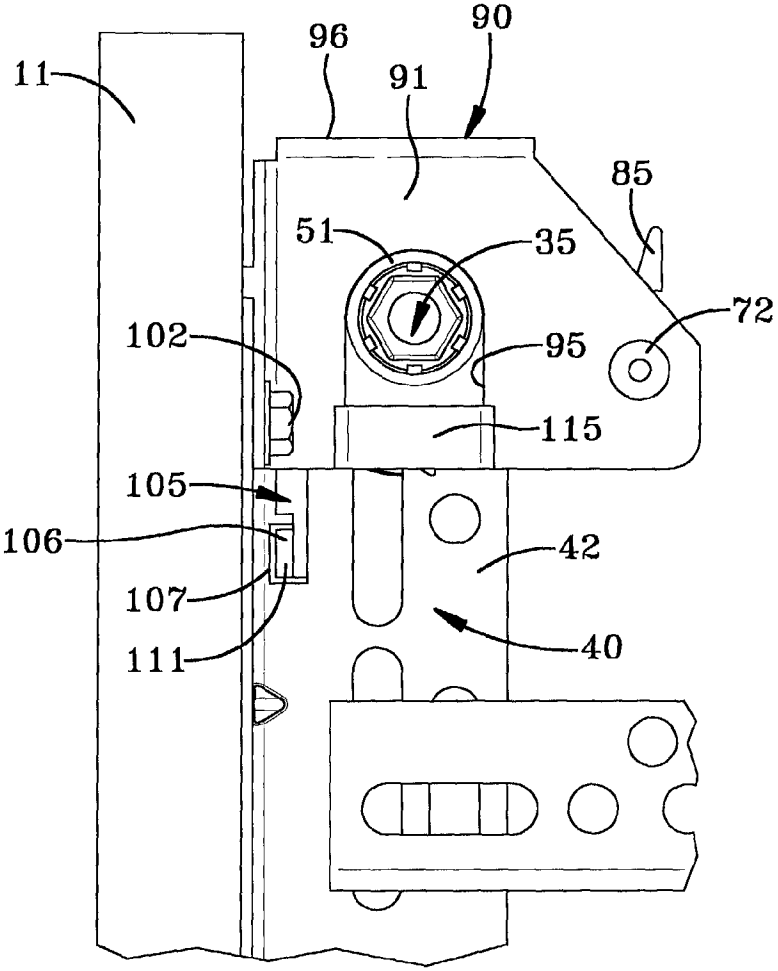
FIG. 6 is a fragmentary enlarged left side elevational view of a winding assembly, as shown in FIG. 1, depicting further details of the winding assembly including a locking assembly coupled to the pawl of the winding assembly to maintain a desired tension on the counterbalance spring, where the locking assembly includes an anchor that interrelates with the bracket to prevent release of tension from the counterbalance spring when the fastener attaching the lock assembly to the frame is removed.

In the industry, there is some concern that a user may errantly remove exposed fasteners, such as cap screw 102, when working near door assembly 10. To guard against accidental release of the tension within the counterbalance spring 26, an anchor, generally indicated by the numeral 105, may be provided on the lock bracket 91 to provide a secondary means of securing the lock bracket 91 to the structure. For example, as shown in FIG. 4, anchor 105 includes a catch 106 that fits within a slot 107 defined in the bracket 40. As best shown in FIGS. 6 and 7, the lock tab 105 operates to catch an edge 108 of the slot 107, such that the tension of the counterbalance spring 26 acting through the various components of the winding assembly 50 holds the lock bracket 91 in a state of static equilibrium with the upper portion of lock plate 91 contacting the structure at one end, the catch contacting the edge 108 of slot 107 to prevent further rotation of the lock bracket 91 under the torsional force of the counterbalance spring 26.

Catch 106 may be may be any member that can stop the movement of the lock bracket 91 including a tab, hook, or other member including the channel-like member shown. In the example depicted in FIG. 4, the catch 106 is a generally U-shaped channel having side walls 111 and a cross member 112 defining a recess therebetween. To reduce the likelihood of the catch 106 slipping from the slot 107, the side walls 111 preferably can be located on either side of the edge 108, such that upon attaining the engaged position (FIG. 7), the side walls 111 are located adjacent either side of support portion 42 and the cross member 112 contacts edge 108. It will also be appreciated that the position of the slot 107 and catch 106 may be reversed with the slot being formed in the lock bracket 91 and the catch 106 being carried on the bracket 40 or mating projections could be used to perform a similar catching function. The installer may secure the lock bracket 91 with a cap screw 102 driven through support bracket 40, such that an average person would not be able to accidentally remove the lock bracket 91 or otherwise release gear 51. This helps eliminate accidental release of the counterbalance system 25 and discourages tampering with the tensioning assembly 50. In operation, winding assembly 50 automatically retains the position of driver 35 and accordingly tension on counterbalance system 25 by biasing pawl assembly 70 into locking engagement with gear wheel 51. In the embodiment shown, to increase force upon the counterbalance system 25, the user would apply a force to driver 35 using pliers, a pipe wrench, rods which may be inserted through sleeve 34, a socket wrench or other tools known in the art. Once the force of counterbalance system 25 is overcome, the gear wheel 51 of winding assembly 50 would rotate past pawl assembly 55. Pawl 71 of pawl assembly 70 would follow the contour of gear wheel 51 in a cam follower-type fashion. As each tooth 53 passes pawl 71, the pawl 71 "clicks" down to the next gear tooth 53. Once the user stops applying a tensioning force, the force of the counterbalance system 25 would cause the gear wheel 51 to rotate in the opposite direction catching the end of pawl 71. Under the force of biasing assembly 80, pawl 71 continues to follow the contour of the gear wheel 51 until the pawl 71 encounters the trailing surface 62 of tooth 53, at which point the counterbalancing force of the counterbalance system 25 is held relative to the support bracket 40 by pawl 71. To reduce the counterbalancing force within counterbalance system 25 while holding the driver 35 with a tool, the user would release pawl 71, as by pressing projection 85 toward the door D. Once the pawl 71 is released, the user may slowly rotate the tool until the gear wheel 51 of winding assembly 50 begins to turn in the direction appropriate to reduce the counterbalancing force. Once sufficiently reduced, the installer would return the pawl 71 to the engaged position, for example, by simply releasing projection 85 to allow the pawl 71 to engage an adjacent notch 54 under the force of biasing assembly 80. Once the appropriate counterbalancing force is achieved within the counterbalance system 25, the installer may lock winding assembly 50 with locking assembly 90, fastening the lock assembly 90 to support bracket 40 to lock the pawl 71 in place to prevent tampering with the winding assembly 50.

Figure 8:
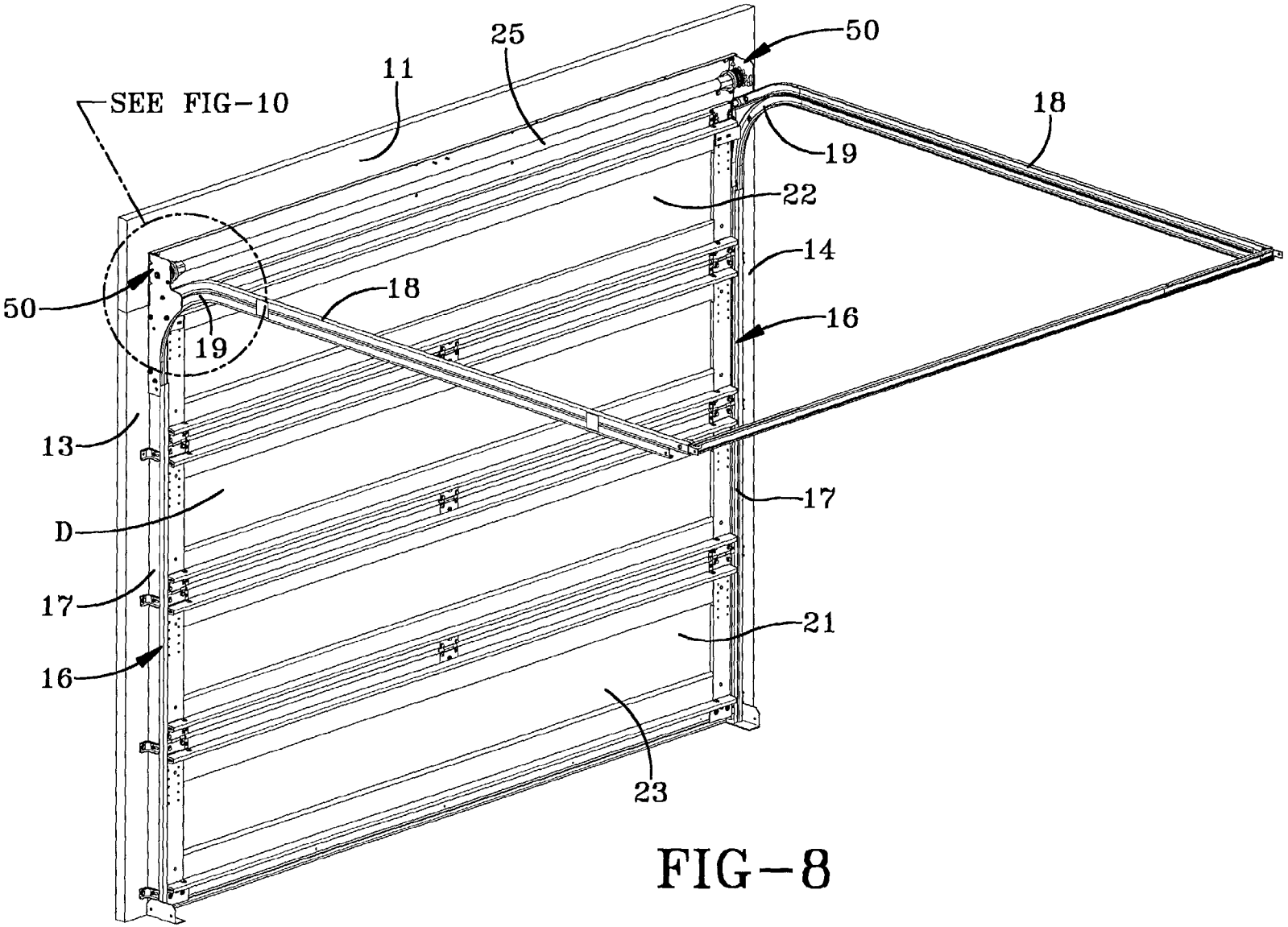
FIG. 8 is a rear perspective view similar to FIG. 1 depicting an alternative winding assembly used in connection with an upwardly acting door, where the winding assembly acts as a splice between the vertical and horizontal track sections to provide a more compact winding assembly.

An alternative winding assembly, generally indicated by the numeral 150, is depicted in FIGS. 6-8. Alternative winding assembly 150 shares many of the same components as the previously described embodiment and the same numbers will be used to describe like components. It will be appreciated that the winding assembly 150 may be included within a door system 10, or be provided as a separate unit to be used with or retrofit to existing systems. It will be appreciated that some modification of such systems may be needed, in the course of using winding assembly 150 with such systems and such modification is within the scope of the present invention. The incorporation of winding assembly 150 in the described door system 10 is provided only as an example. To provide a more compact winding assembly 150, the tool end 34 of driver 35 is omitted, resulting in a shortened driver 135, generally indicated by the numeral 135, having a tool receiving socket 136 extending axially inward from the end 139 of driver 135. Additionally, a splice bracket, generally indicated by the numeral 140, is substituted for bracket 40. Splice bracket 140, similar to bracket 40, includes an attachment flange 141, lying generally parallel to the header 11 and attached thereto, as by a suitable a fastener, and an axle supporting portion 142 extending rearwardly of the header 11. The axle supporting portion includes an opening 143 that receives the end 139 of driver 135. The axial movement of driver 135 may be restrained, as described in the previous embodiment, by a retainer 57 which, for example, may include a retaining ring that fits within a recess formed on the end 139 of shortened driver 135. Splice bracket 140 supports and joins the horizontal and vertical sections of guide tracks 16 at a splice portion 148 extending rearwardly to an extent corresponding with the guide tracks 16. To provide maximum clearance within the structure, the rearward edge 149 of splice portion 148 may be contoured to conform with the profile of the guide tracks 16. For example, as best shown in FIG. 6, the splice portion 148 has a variable rearward dimension that at its lowermost portion 200 is generally of the same dimension as the guide track 16. As the guide track 16 transitions from the vertical track section 17 to the horizontal track section 18, the splice section 148 of bracket 140 progressively extends rearwardly in an arcuate manner generally conforming to the rearward extension of the transitional track section 19. As depicted, it may not be necessary for the splice portion 148 to extend rearwardly to a great extent and, thus, it may be truncated prior to running the full course of the arcuate transition section 19 to form a nose portion 201. Guide track 16 may be supported on the splice bracket 140, as by attachment by suitable fasteners, such as bolts 202.

Since lateral space is limited, the locking assembly 90 is omitted and the pawl assembly 70 and spring assembly 80 are fastened to the splice plate 140. To that end, splice plate 140 includes a receiver 205 adapted to receive retainer 72. The second leg of spring 83 may hook the rearward edge 149 of splice plate 140. To reduce the likelihood of the second end 83 of spring 80 slipping, a recess 210 may be formed in the rear edge 149 of splice plate 140 near the receiver 205. Operation of the compact winding assembly 150 is in accordance with the previously described embodiment.

In light of the foregoing, it should be apparent that the invention as described and shown provides a new and useful improvement in the art. It should further be noted that various modifications and substitutions may be made in the present invention without deviating from the spirit thereof. Thus, for an appreciation of the scope of the present invention, reference should be made to the following claims.

The invention claimed is:

1. A winding assembly used in conjunction with a door having a counterbalance system operable to offset the weight of the door, the counterbalance system including an axle rotatably supported on a pair of support brackets located at each side of the door and a counterbalance spring adapted to apply counterbalancing force to the door, the winding assembly comprising, a rotatable driver adapted to be coupled to the counterbalance spring, said driver having a tool receiving portion, a gear wheel supported on said driver and rotatable therewith, said gear wheel defining a plurality of teeth, said teeth having a leading surface and a trailing surface, a detent formed on said trailing surface of at least one of said teeth, a locking assembly including a lock bracket fastened to one of said pair of support brackets by a fastener, and a pawl pivotally supported on said lock bracket and operable with said gear wheel to selectively engage said teeth and maintain a selected counterbalance force wherein said lock bracket is pivotable relative to said support brackets between a secure position in which said fastener engages one of said support brackets, and a safety position in which said fastener is removed and tension from the counterbalance spring causes said lock bracket to pivot.

2. The winding assembly of claim 1, wherein said pawl is biased toward engagement with said teeth.

3. The winding assembly of claim 2, wherein said pawl is biased by a spring.

4. The winding assembly of claim 3, wherein said spring includes a first leg and a second leg, wherein said first leg bears against said pawl and said second leg is adapted to be held by one of the support brackets.

5. The winding assembly of claim 1, wherein said detent includes a leading surface and a trailing surface, said trailing surface being adapted to provide a positive stop against a surface of said pawl.

6. The winding assembly of claim 5, wherein said trailing surface of said detent extends substantially perpendicular from said trailing surface of said at least one of said teeth.

7. The winding assembly of claim 5, wherein said leading surface of said detent is formed oblique to a path of said pawl.

8. The winding assembly of claim 1, wherein said pawl has a detent receiving notch adapted to seat said detent upon engagement therewith.

9. The winding assembly of claim 8, wherein said pawl includes a lip adjacent said notch adapted to positively engage a trailing surface of said detent.

10. The winding assembly of claim 1, wherein said driver includes a radially extending flange located adjacent the spring.

11. The winding assembly of claim 1, wherein said tool receiving portion of said driver includes a tool end extending axially outwardly of said driver.

12. The winding assembly of claim 11, wherein said tool end includes a faceted outer surface adapted to couple with a wrench.

13. The winding assembly of claim 12, wherein said tool end has a hexagonal cross-section.

14. The winding assembly of claim 11, wherein said tool end defines a tool receiving socket.

15. The winding assembly of claim of claim 14, wherein said tool receiving socket extends axially inward from the end of said driver.

16. The winding assembly of claim 15, wherein said tool receiving socket is adapted to receive an end of a socket wrench.

17. The winding assembly of claim 1, further comprising, a catch carried on said lock bracket, said catch rotationally securing said lock bracket to one of said pair of support brackets to prevent rotation of said lock bracket past said safety position, whereby said locking assembly prevents inadvertent release of the counterbalance force.

18. The winding assembly of claim 1, wherein said lock bracket includes a pair of spaced plates defining a clearance therebetween suitable for receiving said gear wheel, wherein said pawl is mounted between said plates and includes a projection extending externally of said plates allowing manual operation of said pawl.

19. The winding assembly of claim 18, wherein said plates are connected at their upper vertical extremity by a cap member.

20. The winding assembly of claim 17, wherein said catch includes a tab extending from said lock bracket, said tab being adapted to engage an edge of one of said support brackets upon unfastening of said lock bracket.

21. The winding assembly of claim 20, wherein said tab defines a recess adapted for receipt of said edge between first and second portions of said tab.

22. The winding assembly of claim 21, wherein said tab is U-shaped.

23. The winding assembly of claim 17, wherein said locking assembly further includes a slot within one of said support brackets, wherein said catch is received within said slot and adapted to engage an edge of said slot upon unfastening of said lock bracket.

24. A lock assembly in a door system, the door system including a frame, a door movable between an open position and a closed position, the door being supported on a pair of support brackets at either end of the door, a counterbalance system adapted to apply a counterbalancing force to the door, and a winding assembly adapted to adjust and maintain the counterbalancing force, the lock assembly comprising;

a lock bracket coupled to and housing the winding assembly and fastened to the frame by a fastener to fix the winding assembly in a selected position, and a catch extending from said lock bracket, said lock bracket being pivotable between a secure position where said fastener engages one of said support brackets, and a safety position where said fastener is removed and tension from the counterbalance spring causes said lock bracket to pivot, thereby causing said catch to engage one of said support brackets.

25. The lock assembly of claim 24, wherein said catch includes a tab defining an edge receiving recess adapted to receive an edge of one of the support brackets.

26. The lock assembly of claim 25, wherein said tab extends downwardly from said lock bracket and has a U-shaped cross-section.

* * * * *